United States Patent [19]

Brammer et al.

[11] 4,343,285

[45] Aug. 10, 1982

[54] CONTACTLESS IGNITION SYSTEM OF UNITARY CONSTRUCTION

[75] Inventors: Hartmut Brammer, Vaihingen; Heinz Leiber, Leimen, both of Fed. Rep. of Germany

[73] Assignee: Robert Bosch GmbH, Stuttgart, Fed. Rep. of Germany

[21] Appl. No.: 173,734

[22] Filed: Jul. 30, 1980

[30] Foreign Application Priority Data

Sep. 1, 1979 [DE] Fed. Rep. of Germany ..... 2935412

[51] Int. Cl.[3] ..... F02P 5/04; F02P 1/00

[52] U.S. Cl. ..... 123/647; 123/612; 123/617; 123/146.5 A

[58] Field of Search ..... 123/647, 612, 613, 617, 123/146.5 A

[56] References Cited

U.S. PATENT DOCUMENTS

| | | | |
|---|---|---|---|
| 3,807,378 | 4/1974 | Wernet | 123/613 |
| 3,888,225 | 6/1975 | Boyer | 123/146.5 A |
| 3,960,918 | 9/1975 | Longstaff-Tyrell | 123/647 |
| 4,037,577 | 7/1977 | Gallo | 123/146.5 A |
| 4,185,600 | 1/1980 | Brammer | 123/146.5 A |
| 4,224,917 | 9/1980 | Nakazawa | 123/647 |
| 4,235,213 | 11/1980 | Jellissen | 123/647 |

FOREIGN PATENT DOCUMENTS

| | | | |
|---|---|---|---|
| 2442974 | 11/1979 | France | 123/647 |
| 5564158 | 1/1978 | Japan | 123/647 |

*Primary Examiner*—Donald B. Cox

*Attorney, Agent, or Firm*—Frishauf, Holtz, Goodman & Woodward

[57] ABSTRACT

The Hall generator integrated circuit in the transistor-controlled ignition system of an internal combustion engine and an integrated circuit board which carries the circuit elements for overvoltage protection, amplification, and the power output stage are mounted together in one building block. Preferably, the conductive element and the permanent magnet of the Hall generator are also integrated into the building block as is a pressure sensor. The output of the pressure sensor is directly applied to the circuits in the printed circuit board. The unit occupies little space and eliminates the need for external leads interconnecting the ignition coil and the output circuit.

5 Claims, 3 Drawing Figures

CONTACTLESS IGNITION SYSTEM OF UNITARY CONSTRUCTION

The present invention relates to ignition systems in internal combustion engines and, more particularly, to ignition systems with contactless control.

Background and Prior Art

In ignition systems of the above-mentioned type, the circuit member (such as a printed circuit board) which holds the elements for overvoltage protection, amplification, and the ignition output stage, is fastened to the chassis in the vicinity of the motor. This means that not only must sufficient room be provided on the chassis, but also a two-conductor lead must be provided between the circuit member and the ignition coil of the distributor.

In Japanese published application JP-OS 22 639/77, the circuit member which holds the various above-mentioned circuits is a box which is externally fastened to the distributor housing. Both the circuit holding member and the distributor housing have projections and a connecting lead is also provided between the induction coil and the circuits of the circuit holding member.

The Invention

It is an object of the present invention to provide a construction wherein the distributor and the above-mentioned circuit holding member as well as a pressure box are combined to form a compact unit and the external connecting lead between the induction coil and the above-mentioned circuitry is eliminated, and which is particularly to manufacture and results in a particularly compact unit.

In accordance with the present invention, the circuit holding member which includes the overvoltage protection stages, the amplifier stages and the output stages of a contactlessly controlled ignition system in an internal combustion engine forms part of the distributor housing. Stationary parts of a Hall generator such as at least the integrated circuit which is part of the Hall generator and, preferably, also its permanent magnet are also integrated into the single unit.

A pressure box with a rod moving in accordance with motor load and whose position controls the ignition timing is also integrated into the housing so that the need for a separate timing adjust mechanism with pull rod and contact breaker plate is eliminated.

DRAWINGS ILLUSTRATING PREFERRED EMBODIMENTS

Figure 1:
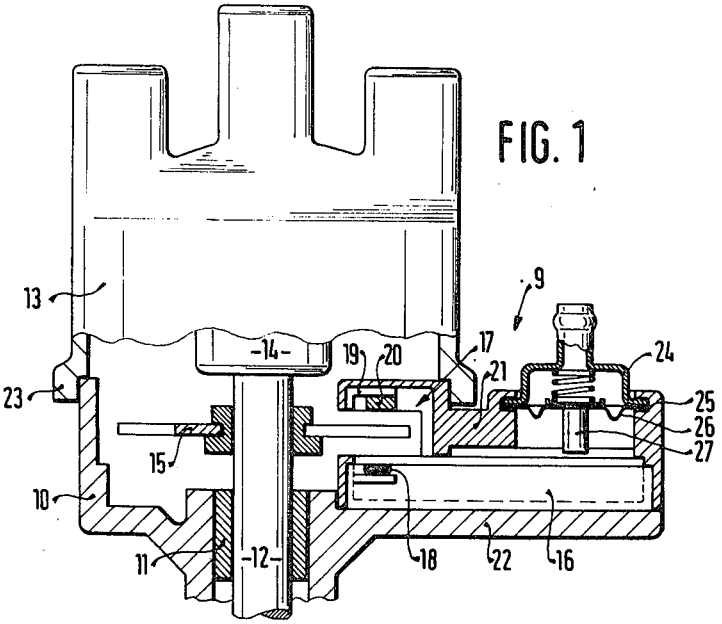
FIG. 1 is an axial view, partially in section and on a one-to-one scale of a first embodiment of the present invention.

An only partially illustrated distributor 9 of FIG. 1 has a housing 10 with a bearing bush 11 in which is mounted a shaft 12 with distributor arm 14. Housing 10 is covered by a distributor cap 13.

Integrated into distributor 9 is a contactlessly controlled transistor-ignition coil apparatus with a Hall generator. The apparatus includes, in the main, a circuit-holding member 16 and the Hall generator 17. The circuit-holding member 16 contains the elements (not illustrated) of a Darlington output stage, an overvoltage protection stage and an amplifier stage. Hall generator 17 includes a rotor 15 which is mounted on shaft 12 for rotation therewith. The rotor includes a plurality of segments as is required for a Hall generator. The integrated circuit (IC) of the Hall generator is denoted by reference numeral 18 and is integrated into the circuit-holding member 16. The Hall generator further includes a conducting piece 19 and a permanent magnet 20, both of which are arranged in a housing 21. Housing 21 is mounted on a plate 22 which extends in the radial direction from distributor housing 10. Edge 23 of distributor cap 13 maintains housing 21 in the proper position. Housing 21 further has a slot 25 which receives a pressure box 24. Pressure box 24 includes a membrane 26 to which is fastened a rod 27. The movement of the latter constitutes a measure of motor load and is applied to the circuit in member 16.

Housing 21 and the stationary parts of Hall generator 17, namely the integrated circuit 18, the conducting piece 19 and permanent magnet 20 as well as pressure box 24 and the circuit-holding member 16 together constitute a single unit.

Figure 2:
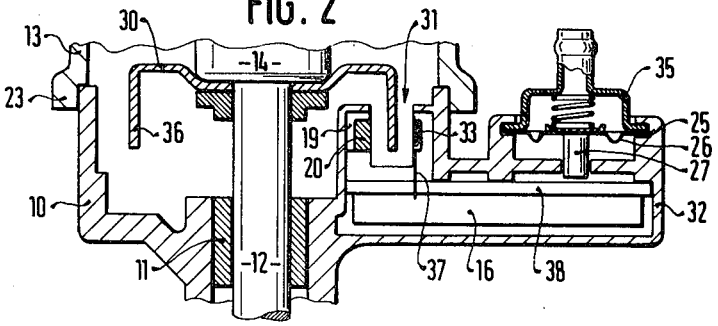
FIG. 2 shows a second embodiment of unitary construction.

In the embodiment shown in FIG. 2, elements which are the same or similar to those shown in FIG. 1 have the same reference numerals. In contrast to the embodiment shown in FIG. 1, in the embodiment in FIG. 2, rotor 30 which is part of the Hall generator consists of a substantially horizontal portion 30 and axially extending rotor segments 36. A line 37 electrically connects the integrated circuit 33 of the Hall generator to the printed circuit board 38 of the circuit-holding member 16. Housing 32 is an integral part of distributor housing 10 i.e., distributor housing 10 and housing 32 are part of the same unit. Housed in housing 32 is the block including the circuit-holding member 16, the stationary portions of the Hall generator, namely the integrated circuit 33, conducting piece 19 and permanent magnet 20. Also housed in housing 32 is a pressure box 35 similar to pressure box 24 and also constituting part of the building block.

Figure 3:
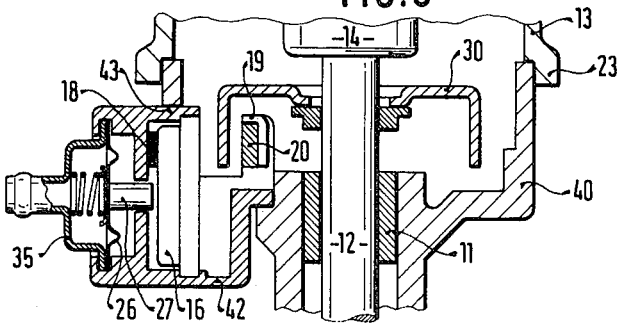
FIG. 3 shows a third embodiment of the present invention.

In the third embodiment, shown in FIG. 3, the above-described building block is received in a housing 42 which is inserted into an opening 43 in the distributor housing 40. The individual elements shown in FIG. 3 correspond to the above-described elements having the same reference numerals.

Various changes and modifications may be made within the scope of the inventive concepts.

We claim:

1. For combination with an internal combustion engine, a unitary contactless controlled ignition system comprising a distributor housing (10,13);

a distributor shaft (12);

a Hall generator (17) including a magnetic circuit having a gap and a segmental rotor (15) moving through said gap, located in the housing;

and a circuit-holding member holding circuit elements forming overvoltage protection circuits, amplifying and output stages, a single building block incorporating said circuit-holding member and said magnetic gap of said Hall generator;

a pressure box (24) having a rod (27) moving along a predetermined path as a function of load on said internal combustion engine, and said single building block being mounted on said distributor housing and said pressure box being integrated in said building block.

2. For combination with an internal combustion engine, a unitary contactless controlled ignition system comprising a distributor housing (10,13);

a distributor shaft (12);

a Hall generator (17) including a magnetic circuit having a gap and a segmental rotor (15) moving through said gap, located in the housing;

and a circuit-holding member holding circuit elements forming overvoltage protection circuits, amplifying and output stages, a single building block incorporating said circuit-holding member and said magnetic gap of said Hall generator;

said distributor housing being formed with an opening (43);

a housing (42) for said building block; and said building block being mounted on said distributor housing and being fitted in said opening of said distributor housing.

3. Apparatus as set forth in claim 1 or 2, wherein said rotor of said Hall generator is mounted on said distributor shaft for rotation therewith;

wherein said Hall generator further comprises an integrated circuit (18, 33); and wherein said integrated circuit is contained in said building block.

4. Apparatus as set forth in claim 3, wherein said magnetic circuit of said Hall generator comprises a permanent magnet (20); and wherein said permanent magnet is mounted in said building block.

5. Apparatus as set forth in claim 1 or 2, wherein said distributor housing (10) comprises a plate (22) extending in radial direction therefrom; and wherein said building block is mounted on said plate.

* * * * *